United States Patent [19]

Kato et al.

[11] Patent Number: 5,016,823

[45] Date of Patent: May 21, 1991

[54] AIR CURRENT CLASSIFIER, PROCESS FOR PREPARING TONER, AND APPARATUS FOR PREPARING TONER

[75] Inventors: Masayoshi Kato, Kawasaki; Hitoshi Kanda, Yokohama, both of Japan

[73] Assignee: Canon Kabushiki Kaisha, Tokyo, Japan

[21] Appl. No.: 346,635

[22] Filed: May 3, 1989

[51] Int. Cl.[5] ..... B02C 19/06

[52] U.S. Cl. ..... 241/5; 209/143; 241/24; 241/29; 241/39; 241/79.1; 241/80; 430/137

[58] Field of Search ..... 430/137; 209/142, 143, 209/144, 154; 241/80, 97, 5, 39, 40, 79.1, 24, 29

[56] References Cited

U.S. PATENT DOCUMENTS

| | | | |
|---|---|---|---|
| 1,897,195 | 2/1933 | Howden | 209/144 |
| 3,877,647 | 4/1975 | Gorobets et al. | 241/79.1 X |
| 4,844,349 | 7/1989 | Kanda et al. | 241/79.1 X |

FOREIGN PATENT DOCUMENTS

| | | | |
|---|---|---|---|
| 246074 | 11/1987 | European Pat. Off. | 209/143 |
| 959846 | 9/1982 | U.S.S.R. | 209/144 |

*Primary Examiner*—Mark Rosenbaum

*Attorney, Agent, or Firm*—Fitzpatrick, Cella, Harper & Scinto

[57] ABSTRACT

A separator for classifying powder with air current, comprises a powder feed pipe and a classifying chamber, provided in said separator; a guide chamber provided at the upper part of said classifying chamber to communicate with said powder feed pipe; a plurality of introducing louvers provided between said guide chamber and said classifying chamber, at which the powder is flowed in from said guide chamber to said classifying chamber through the openings between said introducing louvers together with carrying air; an inclined classifying plate raised at its central part, provided at the bottom of said classifying chamber; classifying louvers provided along the side wall of said classifying chamber, through the openings of which the air is flowed to produce a whirling stream by which said powder fed into said classifying chamber together with carrying air is centrifugally separated into fine powder and coarse powder; a discharge opening provide at the central part of said classifying plate and from which the classified fine powder is discharged; a fine powder discharge chute connected to said discharge opening; and a discharge opening formed along the periphery of said classifying plate and from which the classified coarse powder is discharged.

24 Claims, 8 Drawing Sheets

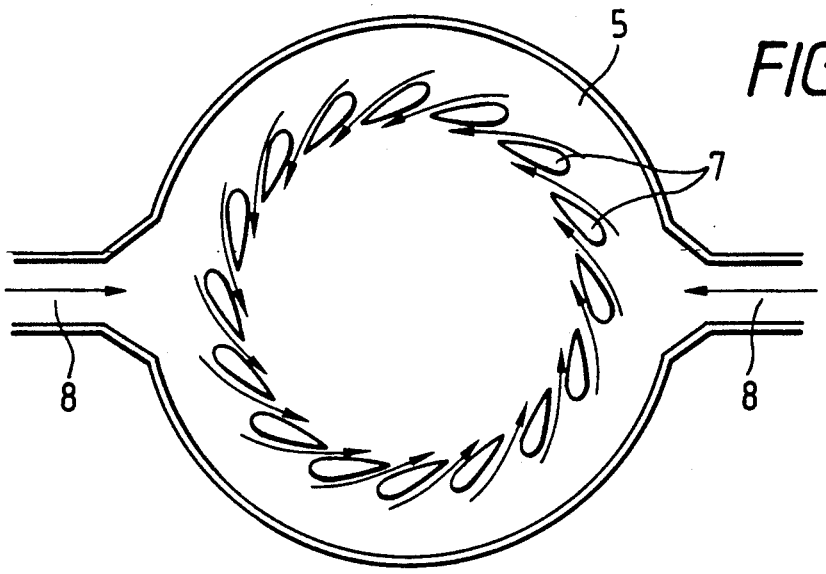
FIG. 3
FIG. 4
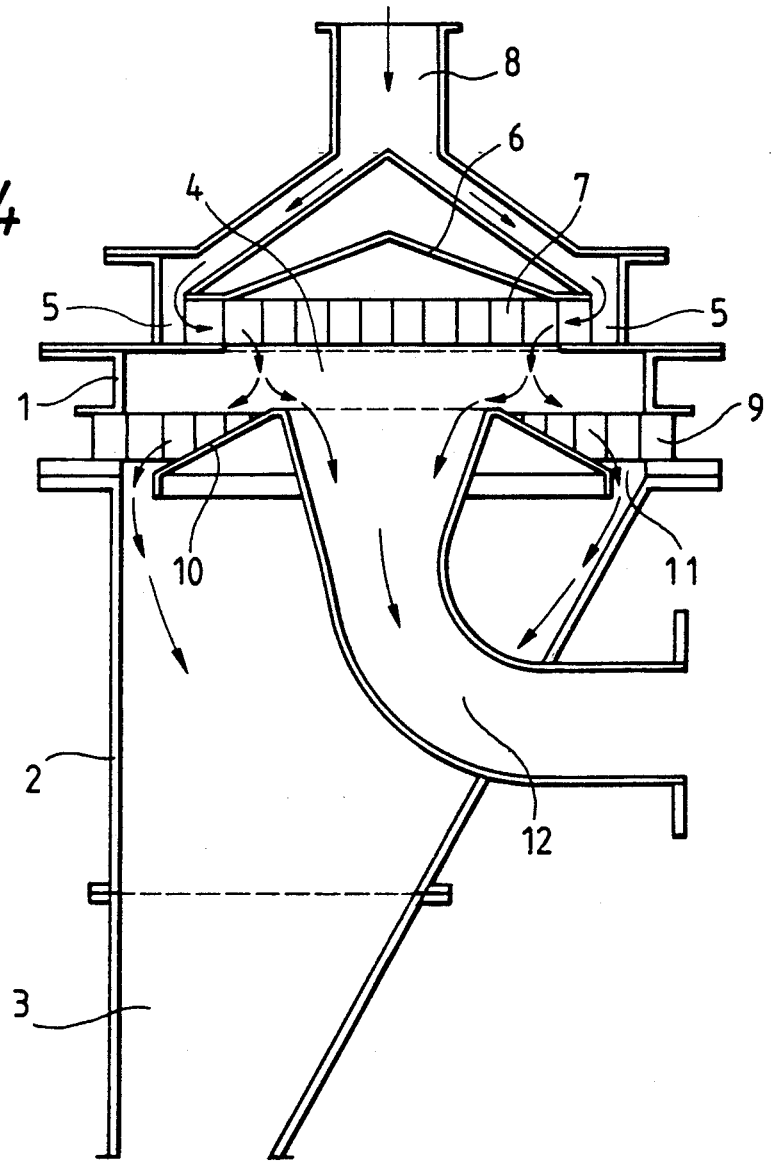

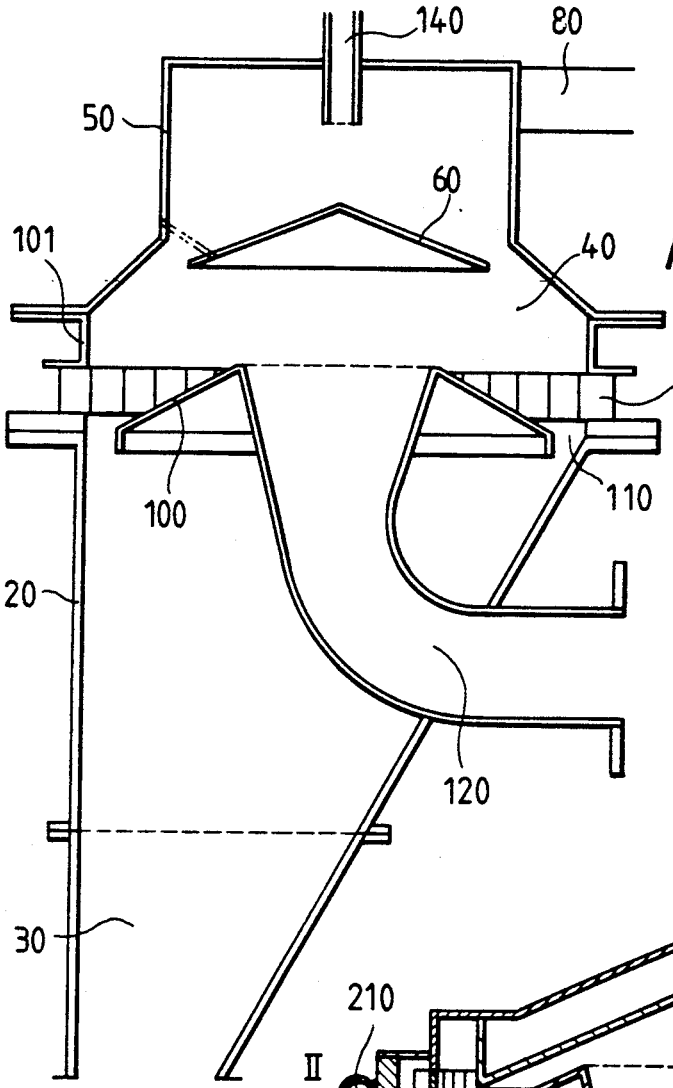
FIG. 5
PRIOR ART
FIG. 6
PRIOR ART
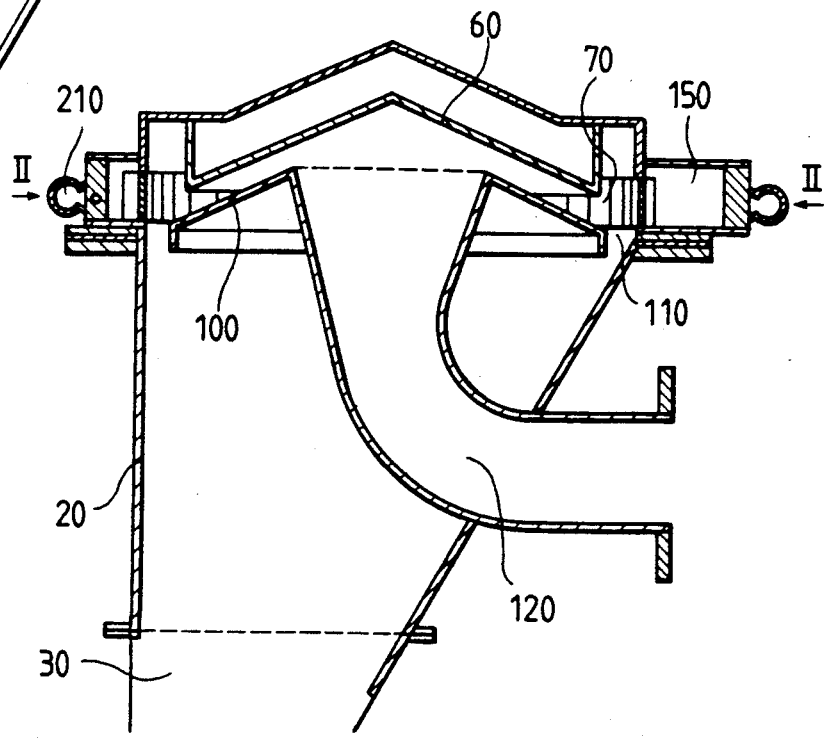

AIR CURRENT CLASSIFIER, PROCESS FOR PREPARING TONER, AND APPARATUS FOR PREPARING TONER

BACKGROUND OF THE INVENTION

1. Field of the Invention

The present invention relates to an air current classifier capable of producing a high-velocity whirling stream on a powder material fed into a classifying chamber, to centrifugally separate the powder material into fine powder and coarse powder. It further relates to an apparatus for preparing a fine powder, equipped with said air current classifier and a jet mill, a process for preparing a toner, having a classification step using said air current classifier, and an apparatus for preparing a toner, having said air current classifier as a classifying means.

2. Related Background Art

As air current classifiers, Classiclon (Nagoya Industrial Science and Technology Laboratory Reports 8 [4] 235,1959), Iitani's classifier (The Journal of the J.S.M.E. Society 59 [3] 215, 1956), etc. have been hitherto proposed. According to these, the size of the particles to be separated depends on the shape of the machine, and it is difficult to control the cut size. These classifiers employ a system in which powder materials are fed into a classifying chamber from one place, and have the problems that the powder can be poorly dispersed, and can be classified with a very low accuracy if the materials are fed at an accelerated velocity, resulting in a shift of the size of separated particles to the coarse side. As a means for solving these problems, Japanese Patent Laid-Open No. 54-48378 proposes a method that enables control of the height of a classifying chamber, and Japanese Patent Laid-Open No. 54- 79870 proposes a method in which a guide cylinder in the shape of a cyclone is mounted on a classifying chamber. Those comprising a combination of these are actually put into practical use.

FIG. 5 schematically illustrates a classifier having been put into practical use.

However, in the air current classifier of this type (comprising the combination of the techniques disclosed in Japanese Patent Laid-Open No. 54- 79870 and No. 54-48378) as illustrated in FIG. 5, a powder material feeding portion to the classifying chamber is in the shape of a cyclone, where a guide cylinder 50 is upright provided at the upper central part of an upper cover 60, and a feed cylinder 80 is connected to the upper peripheral surface of the guide cylinder 50. The feed cylinder 80 is so connected that the powder material fed to the periphery of the guide cylinder 50 through the feed cylinder 80 may be led in the direction tangent to the inner circumference of the guide cylinder. The powder material may be fed from the feed cylinder 80 to the guide cylinder 50, so that the powder material falls down while whirling along the inner circumference of the guide cylinder 50. In this occasion, the powder material falls down in belt-like fashion along the inner circumference of the guide cylinder 50 from the feed cylinder 80, and hence the powder material is flowed into a classifying chamber 40 in a non-uniform dispersion and density (i.e., the powder material is flowed into the classifying chamber from only part of the inner circumference of the guide cylinder), resulting in poor dispersion. If the throughput is made greater, there may arise the problem that the aggregation of powder material becomes more liable to occur, making it impossible for the powder material to be further dispersed and also making is impossible to carry out classification in a high accuracy.

A large quantity of the air that carries the powder material results in a large quantity of the air flowed into the classifying chamber, and hence there arises the problem that the velocity of the particles whirling toward the center in the classifying chamber becomes greater to make larger the size of separated particles. Accordingly, in an attempt to make small the size of separated particles, the air is usually let out from an upper part 140 of the guide cylinder. However, a large quantity of the air let out may sometimes bring about a practical problem that part of the powder material also is released therefrom and lost.

Japanese Utility Model Laid-Open No. 54-81172 proposes an air current classifier comprising, as illustrated in FIG. 6 and FIG. 7 (a cross section along the line II—II), a spiral feed cylinder 150 provided at the peripheral part of a surrounding wall of a classifying chamber in such a manner that the passing area may be gradually reduced as it reaches from the starting end area at the inlet side to the terminal area, a number of louvers provided at a circular communicating area provided between this feed cylinder and the classifying chamber, a circular high-pressure air feeding chamber further provided around the periphery of said feed cylinder, and a plurality of nozzle holes 220 formed in the circumferential direction of the inner peripheral wall of said feed chamber and opened in the same direction as said louvers. In this air current classifier, an improvement has been made so that the powder material fed and dispersed at a uniform velocity from the openings between the louvers may be flowed into the classifying chamber. Since, however, the high-pressure air (A) is so designed as to be jetted from the nozzle holes 220, there is the problem that turbulances are caused by the high-pressure air to lower the accuracy of classification.

Now, some may contemplate a feeding method in which the high-pressure air has been omitted as illustrated in FIG. 8 and FIG. 9 (a cross section along the line III—III). In this method, however, the powder material is flowed along the inner wall of the periphery of the feed cylinder 150 by the action of a centrifugal force, so that it is not uniformly flowed into the classifying chamber from the louvers and is flowed thereinto in a large quantity from the terminal area, and hence it is difficult even to obtain the effect obtainable in the apparatus illustrated in FIGS. 6 and 7.

Moreover, since in the apparatus illustrated in FIGS. 6 and 7 the whirling stream that contributes to the classification in the classifying chamber is only the air flowed in from the openings between the louvers 70, the powder material moves along the periphery of the classifying chamber in the same way as the effect of a cyclone, by the action of a centrifugal force produced by the whirling air current flowed in from the openings between the louvers 70, so that there may arise the problem that the powder material more strongly tends to be captured to make fine powder liable to be included in the coarse powder side.

SUMMARY OF THE INVENTION

Accordingly, an object of the present invention is to provide an air current classifier that has solved the above problems.

Another object of the present invention is to provide an air current classifier that can uniformly feed the powder material into the classifying chamber.

Still another object of the present invention is to provide an air current classifier in which the powder particles whirling in the classifying chamber are made small in their velocity directing toward the center of the classifying chamber, thereby improving the accuracy of classification.

A further object of the present invention is to provide an air current classifier that can classify a fine-particle size powder material in a greater fineness and accuracy than the conventional apparatus.

A still further object of the present invention is to provide an apparatus for preparing a fine powder (particles having a particle diameter of, for example, 1 to 20 μm) in a good efficiency.

A still further object of the present invention is to provide a process for preparing a toner, that can efficiently yield a toner used in development of electrostatic latent images and having fine particle size.

A still another object of the present invention is to provide an apparatus for preparing a toner, that can efficiently yield a toner used in development of electrostatic latent images and having fine particle size.

According to a first aspect of the present invention, there is provided a separator for classifying powder with air current, comprising;

a powder feed pipe and a classifying chamber, provided in said separator;

a guide chamber provided at the upper part of said classifying chamber to communicate with said powder feed pipe;

a plurality of introducing louvers provided between said guide chamber and said classifying chamber, at which the powder is flowed in from said guide chamber to said classifying chamber through the openings between said introducing louvers together with carrying air;

an inclined classifying plate raised at its central part, provided at the bottom of said classifying chamber;

classifying louvers provided along the side wall of said classifying chamber, through the openings of which the air is flowed to produce a whirling stream by which said powder fed into said classifying chamber together with carrying air is centrifugally separated into fine powder and coarse powder;

a discharge opening provide at the central part of said classifying plate and from which the classified fine powder is discharged;

a fine powder discharge chute connected to said discharge opening; and a discharge opening formed along the periphery of said classifying plate and from which the classified coarse powder is discharged.

According to another aspect of the present invention, there is also provided an apparatus for preparing a fine powder, equipped with a jet mill and a separator for classifying powder with air current, wherein;

said separator comprises a powder feed pipe and a classifying chamber, provided in said separator; a guide chamber provided at the upper part of said classifying chamber to communicate with said powder feed pipe; a plurality of introducing louvers provided between said guide chamber and said classifying chamber, at which the powder is flowed in from said guide chamber to said classifying chamber through the openings between said introducing louvers together with carrying air; an inclined classifying plate raised at its central part, provided at the bottom of said classifying chamber; classifying louvers provided along the side wall of said classifying chamber, through the openings of which the air is flowed to produce a whirling stream by which said powder fed into said classifying chamber together with carrying air is centrifugally separated into fine powder and coarse powder; a discharge opening provide at the central part of said classifying plate and from which the classified fine powder is discharged; a fine powder discharge chute connected to said discharge opening; and a discharge opening formed along the periphery of said classifying plate and from which the classified coarse powder is discharged;

a connecting pipe is provided for feeding the classified coarse powder to said jet mill; and a connecting pipe is provided for feeding powder ground in said jet mill, to said powder feed pipe.

According to a still another aspect of the present invention, there is also provided a process for preparing a toner for developing electrostatic latent images, comprising;

melt-kneading a composition comprising at least a binder resin and a colorant, cooling and solidifying the kneaded product, and pulverizing the solidified product to prepare a pulverized feed material;

feeding the pulverized feed material to a first classifying step to classify the feed material into coarse powder and fine powder; wherein said first classifying step is carried out using a separator for classifying the pulverized feed material with air current; said separator comprising; a powder feed pipe and a classifying chamber; a guide chamber provided at the upper part of said classifying chamber to communicate with said powder feed pipe; a plurality of introducing louvers provided between said guide chamber and said classifying chamber, at which the powder is flowed in from said guide chamber to said classifying chamber through the openings between said introducing louvers together with carrying air; an inclined classifying plate raised at its central part, provided at the bottom of said classifying chamber; classifying louvers provided along the side wall of said classifying chamber, through the openings of which the air is flowed to produce a whirling stream by which said powder fed into said classifying chamber together with carrying air is centrifugally separated into fine powder and coarse powder; a discharge opening provide at the central part of said classifying plate and from which the classified fine powder is discharged; a fine powder discharge chute connected to said discharge opening; and a discharge opening formed along the periphery of said classifying plate and from which the classified coarse powder is discharged;

feeding the classified coarse powder to a grinding step and thereafter feeding back the ground product to the first classifying step;

introducing the classified fine powder into a multi-divided classification zone separated into at least three divisions by a dividing means, to which the particles of the fine powder are allowed to fall along curved lines by the Coanda effect, where a coarse powder portion mainly comprised of particles having a particle size above a prescribed range is collected in a first division, a median powder portion mainly comprised of particles having a particle size within the prescribed range is collected in a second division, and a fine powder portion mainly comprised of particles having a particle size below the prescribed range is collected in a third division; and feeding back said coarse powder portion collected, to the first classifying step together with the pulverized feed material.

According to still another aspect of the present invention, there is further provided an apparatus for preparing a toner for developing electrostatic latent image, comprising;

a continuous feed means for continuously feeding a pulverized feed material powder for the toner;

a first classifying means for classifying into fine powder and coarse powder the pulverized feed material fed from said continuous feed means;

said first classifying means comprises a separator for classifying the pulverized feed material with air current; said separator comprising; a powder feed pipe and a classifying chamber; a guide chamber provided at the upper part of said classifying chamber to communicate with said powder feed pipe; a plurality of introducing louvers provided between said guide chamber and said classifying chamber, at which the powder is flowed in from said guide chamber to said classifying chamber through the openings between said introducing louvers together with carrying air; an inclined classifying plate raised at its central part, provided at the bottom of said classifying chamber; classifying louvers provided along the side wall of said classifying chamber, through the openings of which the air is flowed to produce a whirling stream by which said powder fed into said classifying chamber together with carrying air is centrifugally separated into fine powder and coarse powder; a discharge opening provide at the central part of said classifying plate and from which the classified fine powder is discharged; a fine powder discharge chute connected to said discharge opening; and a discharge opening formed along the periphery of said classifying plate and from which the classified coarse powder is discharged;

a grinding means for grinding the coarse powder classified in the first classifying means;

a feeding means for feeding the powder ground by the grinding means;

a multi-divided classifying means having a Coanda block, by which the fine powder classified by said first classifying means is classified into at least a coarse powder portion, a median powder portion and a fine powder portion by the Coanda effect; and a feed-back means for feeding back the coarse powder classified by said multi-divided classifying means, to said continuous feed means.

BRIEF DESCRIPTION OF THE DRAWINGS

FIG. 3 illustrates an example of a modification of what is illustrated in FIG. 2;

FIG. 4 is a longitudinal sectional side elevation of another embodiment;

FIGS. 5, 6 and 8 are longitudinal sections of conventional classifiers;

DETAILED DESCRIPTION OF THE PREFERRED EMBODIMENTS

The present invention will now be described below with reference to the accompanying drawings.

Figure 1:
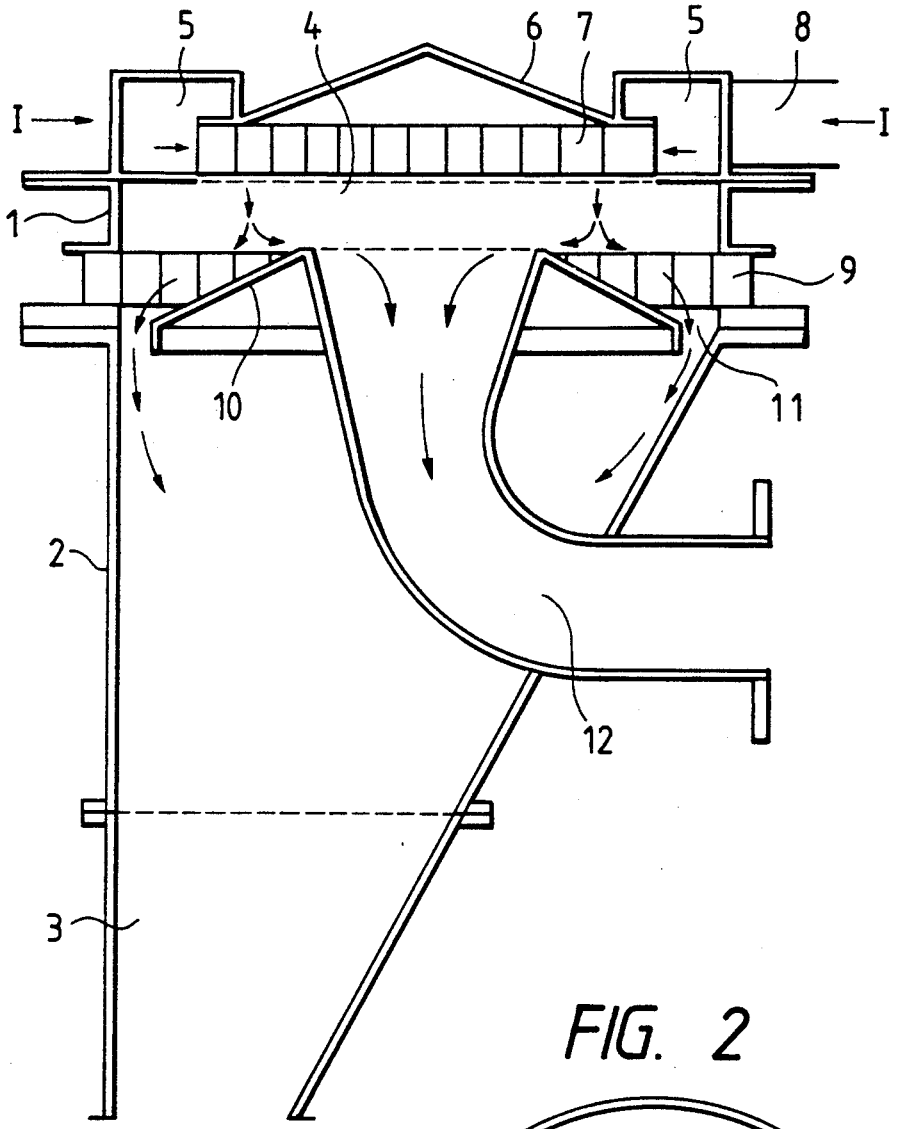
FIG. 1 is a longitudinal sectional side elevation of an air current classifier embodying the present invention.
Figure 2:
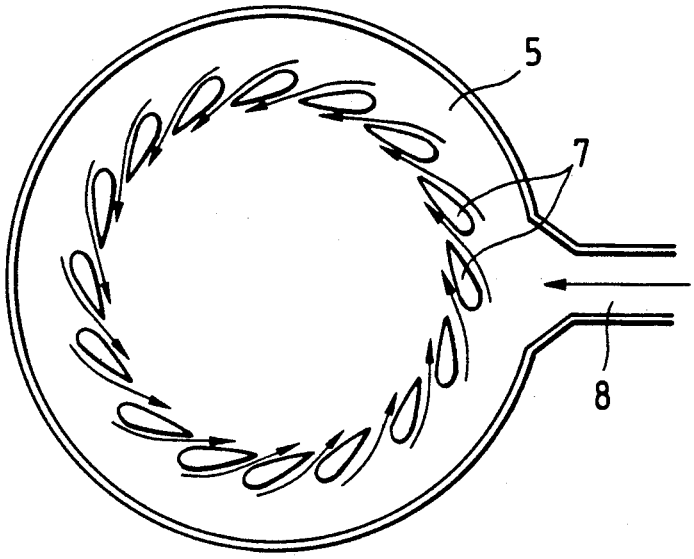
FIG. 2 is a cross section along the line I—I in FIG. 1.
Figure 7:
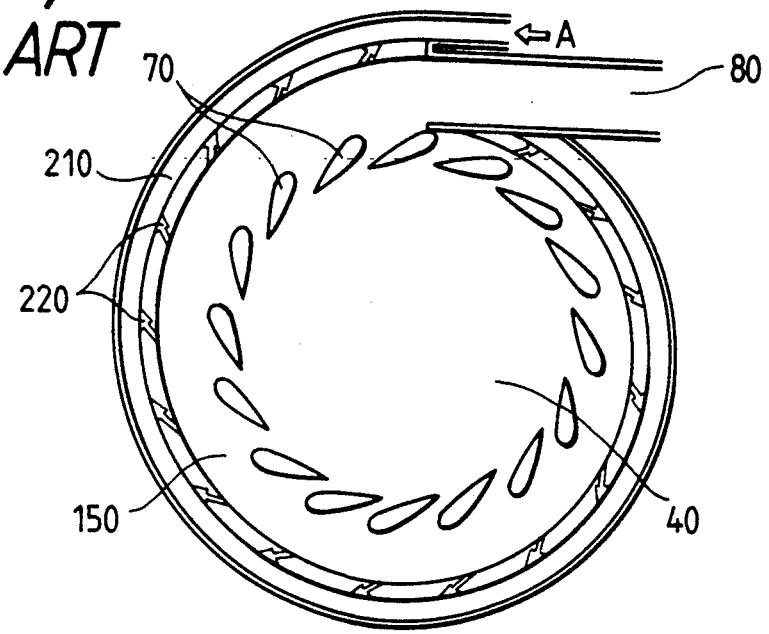
FIG. 7 PRIOR ART
FIG. 7 is a cross section along the line II—II of the classifier illustrated in FIG. 6.
Figure 8:
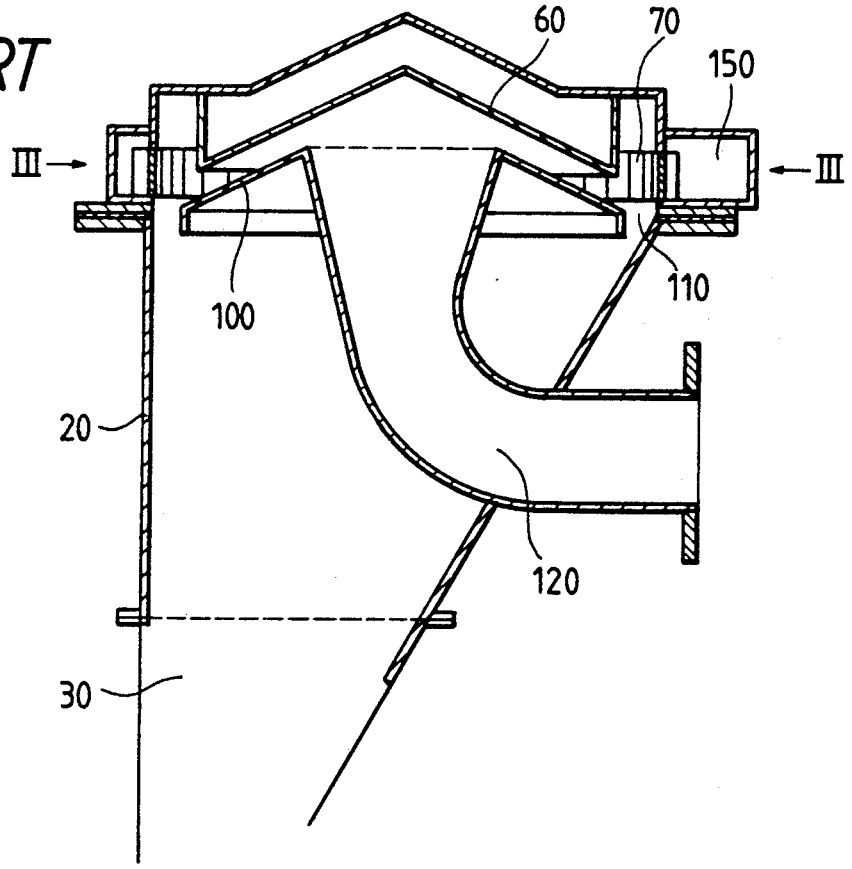
FIG. 8 PRIOR ART
Figure 9:
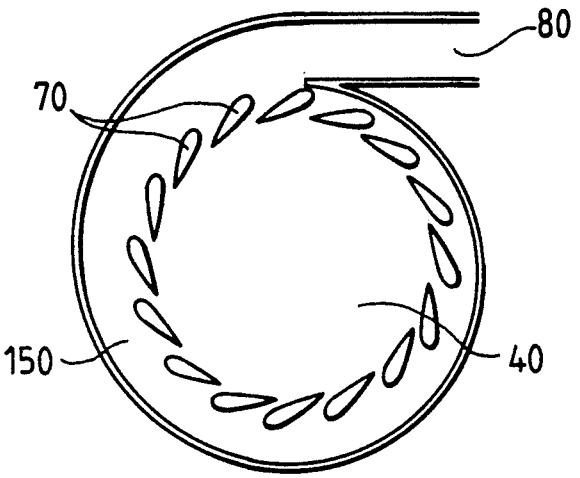
FIG. 9 PRIOR ART
FIG. 9 is a cross section along the line III-13 III of the classifier illustrated in FIG. 8.

FIGS. 1 and 2 schematically illustrate an example of the air current classifier of the present invention.

In FIG. 1, the numeral 1 denotes a main body casing; and 2, a lower part casing, to which a coarse powder discharge hopper 3 is connected at its lower part. A classifying chamber 4 is formed inside the main body casing 1, and the upper part of this classifying chamber is closed by a circular guide chamber 5 mounted on the top of the main body casing 1 and by a conical (or bevel) top cover 6 raised at its central part.

A plurality of introducing louvers 7 (hereinafter "louver 7") arranged in the circumferential direction are provided on a partition wall between the classifying chamber 4 and the guide chamber 5, where the powder material and air fed into the guide chamber 5 are whirlingly flowed into the classifying chamber 4 from the openings between the respective louvers 7. For achieving accurate classification, the air and powder material flowed inside the guide chamber 5 through a feed pipe 8 (the feed pipe should be construed to include a round, square or polygonal one in its cross-section with respect to the present invention) are required to be uniformly distributed to the respective louvers 7. The flow path through which they reach the louvers 7 is required to take the form that may cause concentration by centrifugal force with difficulty. Accordingly, as illustrated in FIG. 2, the feed pipe is connected to the guide chamber in the perpendicular direction with respect to the direction tangent to the peripheral surface of the guide chamber, and communicates with the guide chamber having a sufficient space at the upper part of the louvers. As illustrated in FIG. 3, the feed pipe 8 may be provided in plurality. As illustrated in FIG. 4, the feed pipe 8 may also be connected from the perpendicularly upper direction with respect to the plane of the classifying chamber 4.

In this way, the air and powder material are fed to the classifying chamber 4 through the louvers 7, and when they are fed to the classifying chamber 4 through the louvers 7, their dispersion can be more remarkably improved than the conventional systems. The louvers 7 are movable, and the intervals of louvers are adjustable.

Figure 15A:
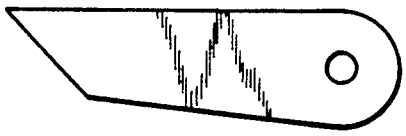
FIGS. 15A and 15B are a plan view and a front view, respectively, schematically illustrating an example of the louver used in louvers 7 and classifying louvers 9.
Figure 15B:
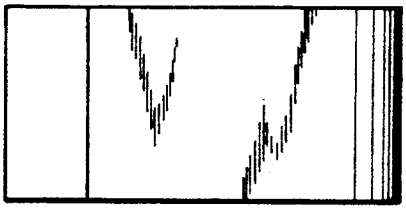

The louver 7 are arranged in the form of a ring as shown in FIGS. 2 and 3, and may preferably be so arranged that the powder flowed in from the openings of the louvers 7 and the carrying air for carrying said powder may produce a whirling stream in the classifying chamber, and thus the powder can be well dispersed in the classifying chamber. As the shapes of the louvers 7, examples are the louvers as illustrated in FIGS. 15A and 15B.

At the lower part of the main body casing 1, classifying louvers 9 arranged in the circumferential direction are provided, from which classifying air for producing a whirling stream is taken into the classifying chamber 4 from the outside through the classifying louvers 9.

A conical (or bevel) classifying plate 10 raised at the central part is provided at the bottom of the classifying chamber 4, and a coarse powder discharge opening 11 is formed on the periphery of said classifying plate 10. A fine powder discharge chute 12 is connected to the central part of the classifying plate 10, and a lower end of the chute 12 is bent in the shape of an L. An end portion of this bend is made to be at the position external to the side wall of the lower part casing 2. This chute is further connected to a suction fan through a fine powder collecting means such as a cyclone or dust collector, where a suction force is acted in the classifying chamber 4 by the operation of the suction fan, and the whirling stream necessary for the classification is produced by the suction air flowed into the classifying chamber 4 from the openings between the louvers 9.

The classifying louvers 9 are arranged in the form of a ring at the lower part of the main body casing 1, and may preferably be so arranged that the classifying air may be flowed in from the openings of the classifying louvers 9 in the same direction as the whirling direction of the powder and carrying air flowed in from the openings of the louvers 7.

The air current classifier shown in Examples is constructed as above, and the powder material may be fed together with air into the guide chamber 5 from the feed pipe 8, so that the air containing this powder material is flowed from the guide chamber 5 through the openings between the louvers 7 into the classifying chamber 4 while whirling and while being dispersed in a uniform density.

The powder material flowed into the classifying chamber 4 while whirling is forced to whirl in an increasing velocity b y being carried on the suction air flowed in from the openings between the classifying louvers 9 at the bottom of the classifying chamber 4, by the operation of the suction fan connected to the fine powder discharge chute 12, and centrifugally separated into fine powder and coarse powder by the centrifugal force acting on the particles. The coarse powder that whirls around the periphery inside the classifying chamber 4 is discharged from the coarse powder discharge opening 11, and discharged from the hopper 3 at the lower part. The fine powder that moves to the central part along the upper inclined surface of the classifying plate 10 is discharged to the fine powder collecting means through the fine powder discharge chute 12.

The air flowed into the classifying chamber 4 together with the powder material is flowed entirely in the form of a whirling stream, and hence the velocity toward the center, of the particles that whirl inside the classifying chamber 4, becomes relatively small as compared with the centrifugal force and the classification for separated particles with a smaller size is achieved in the classifying chamber 4, so that the fine particles having a very small particle size can be discharged to the fine powder discharge chute 12. Moreover, since the powder material is flowed into the classifying chamber in substantially uniform density, the powder can be obtained with a finely accurate distribution.

Figure 10:
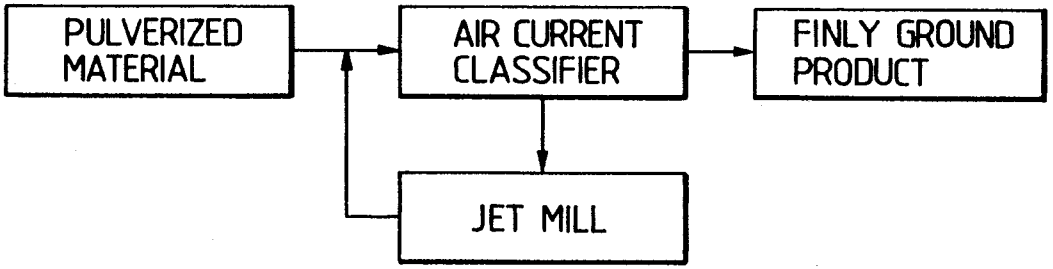
FIG. 10 shows a flow chart of a system in which an air current classifier and a jet mill are connected.

In particular, in an instance where the air current classifier of the present invention is used in a system in which, as illustrated in FIG. 10, the classifier is directly connected to a jet mill to serve as a classifier for the jet mill, where the coarse particles are separated among the particles resulted from the grinding by the jet mill and again fed back to the jet mill so as to be further ground, the above classification effect becomes more remarkable since the quantity of the air fed into the classifier (the quantity of the air flowed in from the feed pipe 8) becomes larger. In this instance, the quantity of the grinding air used in the jet mill should be made larger when the throughput in the jet mill is made larger or when ground products with a smaller particle size are obtained, so that a more remarkable dispersion effect can be achieved.

In order to combine the jet mill used as a jet system grinding machine with the air current classifier of the present invention to provide the apparatus for preparing a fine powder, it is preferred that the hopper 3 from which the classified coarse powder is discharged is made to communicate with a feed opening of the jet mill from which the material to be ground is fed in, and they are connected by a connecting means such as a connecting pipe so that the powder ground in and discharged from the jet mill may be fed to the feed pipe 8 of the classifier.

In the present invention, the methods of flowing the air to produce the whirling stream at the lower part of the classifying chamber 4 are by no means limited to the suction air system as illustrated in FIG. 1, in which the air is flowed in from the external air through the openings between the classifying louvers 9.

Figure 11:
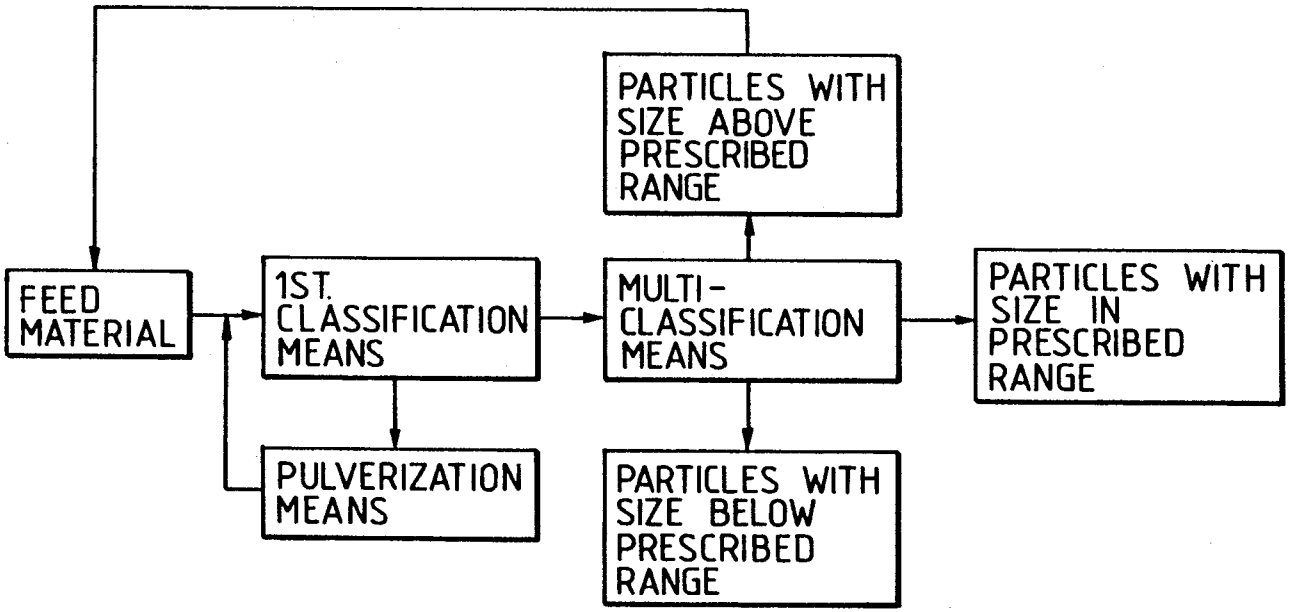
FIG. 11 show a flow chart to describe an example of the process for preparing, and apparatus for preparing, a toner according to the present invention.
Figure 14:
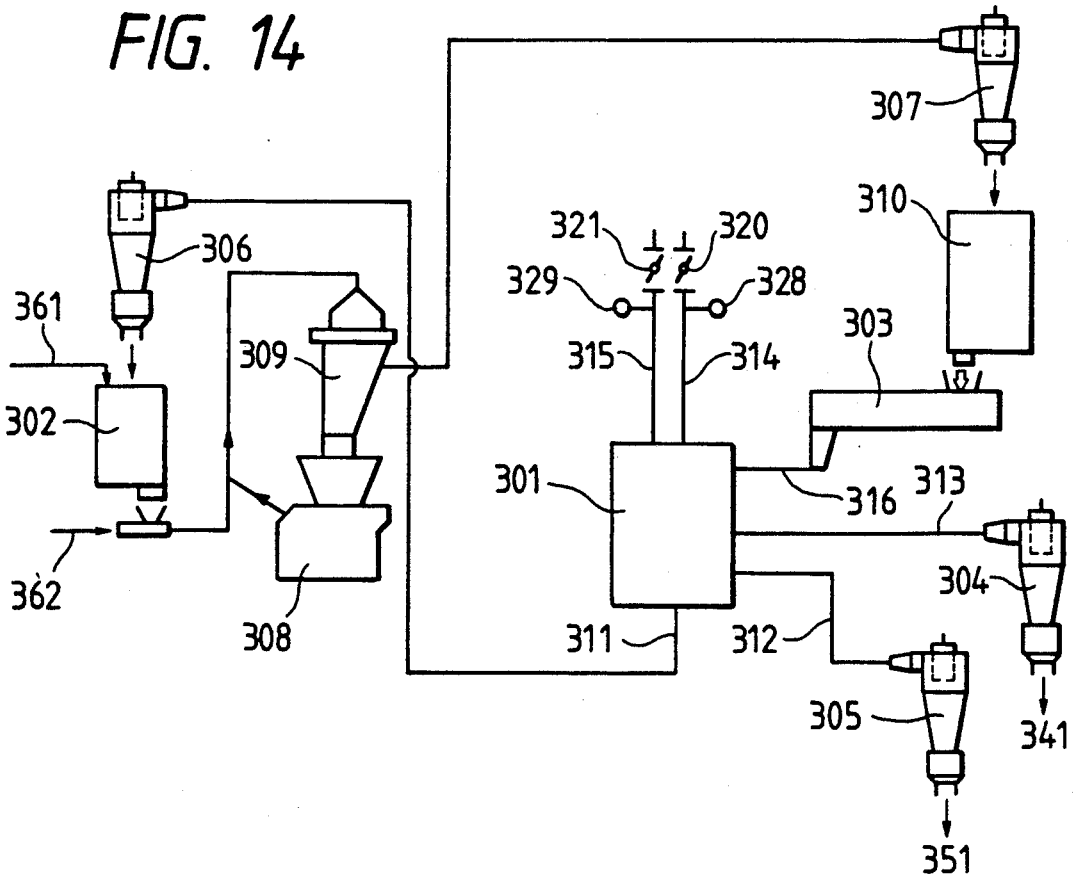
FIG. 14 is a schematic illustration of an apparatus for preparing a toner, used for working the preparation process of the present invention.

An example of the process and apparatus for preparing a toner is shown in FIGS. 11 and 14.

FIG. 11 is a flow chart. The coarse particles fed to a first classifying means and classified there to remove a coarse powder portion from a pulverized powder feed material 361 are forwarded to a suitable grinding means, and fed back again to the first classifying means after they are ground. The fine powder from which the coarse particles have been removed are forwarded to a multi-classification zone, where the powder is classified into at least three particle size portions consisting of a larger particle size portion (a coarse powder mainly comprised of particles having a particle size above the prescribed range), a median particle size portion (a median powder mainly comprised of particles having a particle size within the prescribed range, and a smaller particle size portion ( a fine powder mainly comprised of particles having a particle size below the prescribed region). The particles of the larger particle size portion is fed to the first classifying means together with the feed material 361 and again ground by a grinding means. If necessary, a part of the particles of the larger particle size portion may be fed back to the melting step and reused.

The particles of the median size portion, having a particle size within the prescribed range, and particles of the smaller particle size portion, having a particle size below the prescribed range are taken off through a suitable take-off means. The particles obtained from the median particle size portion have a preferable particle size distribution, and can be used as the toner as they are. On the other hand, the particles of the smaller particle size portion may be fed back to the melting step and reused.

The powder to be classified may preferably have a true specific gravity of from about 0.5 to about 2, and more preferably from 0.6 to 1.7, in view of the classification efficiency.

Figure 12:
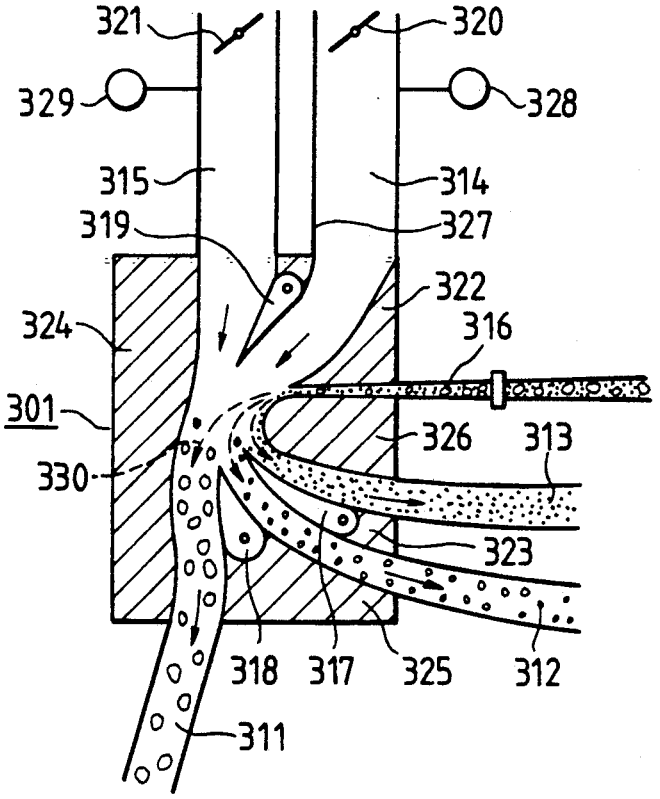
FIGS. 12 and 13 are a cross section and a perspective section, respectively, of a multi-division classifier, which is an example for working a multi-divided classifying means.
Figure 13:
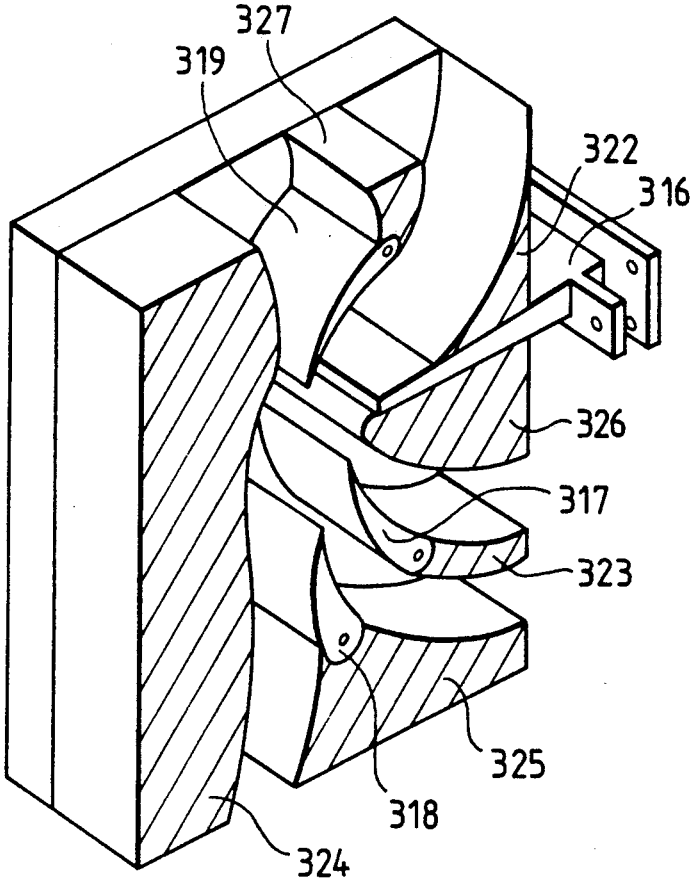

As a means for carry out classification in a high classification efficiency, a multi-division classifier of the system as illustrated in FIG. 12 (a cross section) and FIG. 13 (a perspective view) can be exemplified as am embodiment. In FIGS. 12 and 13, side walls have the shapes as indicated by the numerals 322 and 324 and a lower wall has the shape as indicated by the numeral 325, where the side wall 323 and the lower wall 325 are provided with knife edge-shaped classifying wedges 317 and 318 respectively, and these classifying wedges 317 and 318 separate the classifying zone into three divisions. A fine powder feed nozzle 316 opening into the classifying chamber is provided at the lower part of the side wall 322. A Coanda block 326 is disposed along an extension of the lower tangential line of the nozzle 316 so as to form a long elliptic arc that curves downward. The classifying chamber has an upper wall 327 provided with a knife edge-shaped air-intake wedge 319 extending downward, and further provided above the classifying chamber with air-intake pipes 314 and 315 opening into the classifying chamber. The air-intake pipes 314 and 315 are resectively provided with a first as feed control means 320 and a second gas feed control means 321, respectively, comprising, e.g. a damper, and also provided with static pressure gauges 328 and 329. The locations of the classifying wedges 317 and 318 and the air-intake wedge 319 may vary depending of the kind of the feed material to be classified, and also the desired particle size. At the bottom of the classifying chamber, discharge openings 311, 312 and 313 opening into the chamber are provided corresponding to the respective divisions. The discharge openings 311, 312 and 313 may be respectively provided with shutter means like valve means.

The fine powder feed nozzle 316 comprises a flat rectangular pipe section and a tapered rectangular pipe section, and the ratio of the inner diameter of the flat rectangular pipe section to the inner diameter of the inner diameter of the narrowest part of the tapered rectangular pipe section may be set to from 20:1 to 1:1, and preferably from 10:1 to 2:1, to obtain a good feed velocity.

The classification in the multi-divided classifying zone having the above construction is operated, for example, as follows. The inside of the classifying chamber is evacuated through at least one of the discharge openings 311, 312 and 313. The fine powder is fed at a high velocity to the classifying zone through the fine powder feed nozzle 316 opening into the classifying zone, at a flow velocity of from 50 m/sec to 300 m/sec utilizing a gas stream flowing as a result of the evacuation. The first gas feed control means 320 is driven so that the absolute value of a static pressure $P_1$ in the vicinity of the upstream part of the air-intake pipe 314 may be adjusted to 150 mm.aq. or more, and preferably 200 mm.aq. or more, and the second gas feed control means 321 is driven so that the absolute value of a static pressure $P_2$ in the vicinity of the upstream part of the air-intake pipe 315 may be adjusted to 40 mm.aq., and preferably from 45 to 70 mm.aq., thereby adjusting the absolute value $|P_1|$ of the static pressure $P_1$ and the absolute value $|P_2|$ of the static pressure $P_2$ so as to satisfy the relation:

$$|P_1| - |P_2| \geqq 100$$

This is preferred in order to increase the accuracy of classification. The absolute value of the static pressure $P_2$ may preferably be in the range of from 45 to 70 mm.aq., so that the fine powder and coarse powder can be more widely dispersed in the classifying zone to make it easy to control the cut size.

An instance where $|P_1| - |P_2| = 100$ may result in a lowering of the accuracy of classification and make it impossible to accurately remove the fine powder portion, thus highly tending to bring about classified products having a broard particle size distribution. Feeding the fine powder to the classifying zone at a flow velocity of below 50 m/sec may make it impossible to well disintegrate the aggregation of the aggregates present in the fine powder, thus tending to cause a lowering of the classification yield and accuracy of classification. Feeding the fine powder to the classifying zone at a flow velocity of above 300 m/sec may result in collision between particles to cause the size reduction of particles to newly produce fine particles, thus tending to lower the classification yield.

The fine powder thus fed is moved with a curve 330 by the action attributable to the Coanda effect of the Coanda block 326 and the action of gases such as the air concurrently flowed in, and classified corresponding to the particle size and weight of the respective particles. If the particles in the fine powder have the same specific gravity, larger particles (coarse particles) are classified to the outside of air current, i.e., the first division at the left side of the classifying wedge 318, median particles (particles having a particle size within the prescribed range) are classified to the second division defined between the classifying wedges 318 and 317, and smaller particles (particles having a particle size below the prescribed range) are classified to the third division at the right side of the classifying wedge 317. The larger particles thus classified are discharged from the discharge opening 311, the median particles are discharged from the discharge opening 312, and the smaller particles are discharged form the discharge opening 313, respectively. The particles classified to the second division zone may preferably be made to have an average particle diameter of from about 1 to 15$\mu$ by controlling conditions for the classification.

In working the above process, it is usual to use a unit communication system in which usually the equipments are connected to communicating means such as pipes. A preferred example of such a unit system is shown in FIG. 14. In the unit system as illustrated in FIG. 14, a three-division classifier 301 (of the type as illustrated in FIGS. 12 and 13, details of which are as previously described), a continuous feeder 302, a continuous feeder 310, a vibrating feeder 303, a collecting cyclone 304, a collecting cyclone 305, a collecting cyclone 306, a collecting cyclone 307, a grinding machine 308, and a first classifier 309 (using, for example, the air current classifier as illustrated in FIG. 4) are all mutually connected.

In this unit system, the pulverized feed material is fed into the first classifier 309 through the continuous feeder 302, and the fine powder from which the coarse powder portion has been removed as desired is fed into the continuous feeder 310 through the collecting cyclone 307 and then fed into the three-division classifier 301 from the vibrating feeder 303 through the fine powder feed nozzle 316 at a high velocity. The coarse powder particles classified in the first classifier 309 are sent into the classifier 308 and ground, and then fed again into the first classifier 309 together with a pulverized feed material newly fed. When fed into the three-division classifier 301, the ground product is suction fed at a flow velocity as high as 50 to 300 m/sec, utilizing the suction force of the collecting cyclone 305 and/or collecting cyclone 306. In the suction feeding, the unit system is preferred since the unit systems are not so strictly required to be sealed as in the pressure feeding.

The classifying zone of the classifier 301 is constructed usually with a size of [10 to 50 cm]×[10 to 50 cm], so that the ground product can be instantaneously classified in 0.1 to 0.01 second or below, into three or more kinds of particles. And, the ground product is classified by the three-division classifier 301 into the larger particles (particles having a particle size of the prescribed range), median particles (particles having a particle size within the prescribed range) and smaller particles (particles having a particle size below the prescribed range). Thereafter, the larger particles are passed through a discharge guide pipe 311 and fed back, through the collecting cyclone 306, to the continuous feeder 302 holding the pulverized feed material.

The median particles are discharged outside the system through the discharge pipe 312, and collected as a median powder 351 in the collecting cyclone 305 so as to be used as a toner product. The smaller particles are discharged outside the system through the discharge pipe 313, collected in the collecting cyclone 304, and then recovered as a fine powder 341 having a particle size outside the prescribed range. The collecting cyclones 304, 305 and 306 also function as suction evacuation means for suction feeding the fine powder to the classifying zone through the nozzle 316.

As the grinding machine 308, there can be used grinding means such as impact mill and jet mill. The impact mill includes Turbo Mill, available from Turbo Kogyo K.K., and the grinding machine that utilizes a jet stream includes Supersonic Jet Mill PJM-I model, available from Nipon Pneumatic Kogyo K.K., and Micron Jet, available from Hosokawa Micron K.K. the multi-division classifier used in the process of the present invention includes a classification means that utilizes the Coanda effect, having the Coanda block, as exemplified by Elbow Jet, available from Nittetsu Kogyo K.K.

Usually the toner for developing electrostatic latent images is prepared by melt kneading the starting materials such as a binder resin, comprising a thermoplastic resin as exemplified by styrene resins, styrene-acrylate resins, styrene-methacrylate resins and polyester resins, a colorant (and/or a magnetic material), an offset preventive agent and a charge control agent, followed by cooling, pulverizing, and classification.

In the process of the present invention, the powder is ground, thereafter the ground product is classified using the classifier as illustrated in FIG. 4, the classified powder is further fed to the classifying zone to carry out the instantaneous classification into at least three portions, so that the aggregates previously mentioned may be formed with difficulty, and, even when formed, the aggregates can be disintegrated or can be removed to the coarse powder portion. Thus, the process can obtain classified products (used as the toner) comprising particles with uniform composition and having an accurate particle size distribution.

The toner comprised of the powder obtained by the process and apparatus of the present invention provides a stable triboelectric quantity between toner particles, between the toner and a sleeve, between the toner and a toner transporting material such as a carrier. Hence, it very little suffers development fog and the scattering of toner around edges of latent images, can obtain a high image density, and can improve the reproducibility of half tone. It can also retain the initial performance even when a developer is continuously used over a long period of time, and provide images with a high quality for a long term. Moreover, also when used under environmental conditions of high temperature and high humidity, ultrafine particles and aggregates thereof are so little present that the triboelectric quantity of the developer can be stable. Also, the triboelectric quantity may hardly change when compared with that under normal temperature and normal humidity, so that the fogging or the lowering of image density may little occur, and development can be performed with fidelity to latent images. Moreover, the resulting toner image can be transferred to transferring medium such as paper with a superior transfer efficiency. Even when used under conditions of low temperature and low humidity, the triboelectric quantity distribution may hardly change and can be stable, when compared with that under normal temperature and normal humidity. Since the ultrafine particle component having a very large charge quantity per unit weight is removed, the toner obtained by the process of the present invention has the advantageous features that it is free from the lowering of image density and the fogging, and also substantially free from the roughness or the scattering during transfer.

In preparing the median powder having a small particle size (for example, an average particle diameter of 3 to 7μ), the present invention can be worked more efficiently than the conventional processes.

EXAMPLES

The present invention will be described below in greater detail by giving Examples. In the following, "part(s)" is by weight.

EXAMPLE 1

| | |
|---|---|
| Styrene-acrylate resin (copolymerization weight ratio: 7:3; weight average molecular weight: about 300,000) | 100 parts |
| Magnetite powder (particle diameter: about 0.2 μ) | 80 parts |
| Low-molecular polypropylene (weight average molecular weight: about 3,000) | 2 parts |
| Positive chargeability control agent | 2 parts |

A toner material comprising a mixture with the above formulation was melt kneaded at 180° C. for about one hour, followed by cooling to effect solidification, and the product was pulverized into coarse particles of 100 to 1,000μ with a hammer mill. The coarse pulverized product 361 had a true specific gravity of about 1.5. The resulting coarse pulverized product 361 was put in the continuous feeder 302, and fed into the first classifier 309 at a rate of 250 g/min. The air current classifier as illustrated in FIG. 4 was used as the first classifier 309. Twenty (20) louvers were used as the louvers 7, and arranged in the form of a ring like those in FIG. 2. The openings between the louvers was adjusted to have a space of about 4 to 10 mm. Twenty-five (25) louvers were used as the classifying louvers 9, and the openings between the classifying louvers were adjusted to have a space of about 2 to 3 mm. The classifying louvers were so provided that the whirling stream of the carrying air flowed in through the openings between the louvers 7 may be in the same direction with the whirling stream of the air flowed in through the openings between the classifying louvers 9. The coarse pulverized product 361 was carried on the air through the feed pipe 8, and fed into the classifying chamber 4 in a well dispersed state together with the air through the openings between the louvers 7. The coarse pulverized product 361 fed into the classifying chamber 4 was classified into coarse powder and fine powder by the action of the classifying air taken in through the classifying louvers 9. The classified coarse powder was ground in a jet mill, the grinding machine 308, (Supersonic Jet Mill PJM-I-5; available from Nippon Pneumatic Kogyo K.K.), and, after ground, fed back to the first classifier 309. The particle size distribution of the fine powder classified in the first classifier 309 was measured to find that the fine powder had a volume average diameter of about 7.3μ, containing 12% by volume of particles having a particle diameter of 4.0μ or less and containing 3.0% by volume of particles having a particle diameter of 12.7μ or more. This resulting fine powder was put into the continuous feeder 310, and fed into the multi-division classifier 301 as illustrated in FIGS. 12 and 13, through the vibrating feeder 303 at a rate of 250 g/min, so as to be classified into three kinds of the coarse powder, median powder and fine powder by utilizing the Coanda effect. As the multi-division classifier utilizing the Coanda effect, Elbow Jet EJ-5-3 (available from Nittetsu Kogyo K.K.) was used.

In feeding the fine powder, the collecting cyclones 304, 305 and 306 communicating with the discharge pipes 311, 312 and 313 were operated to evacuate the inside of the system as a result of the suction evacuation, thereby producing a suction force, by the action of which the ground product was fed to the feed nozzle at a flow velocity of about 100 m/sec. The static pressure $P_1$ at the upstream part of the intake pipe 314 and the static pressure $P_2$ at the upstream part of the intake pipe 315 were controlled at −290 mm.aq. (gauge pressure; pressure differential to the atmospheric pressure) and −70 mm.aq. (gauge pressure; pressure differential to the atmospheric pressure), respectively. The ground product thus fed was instantaneously classified in 0.01 second or less. In the collecting cyclone 305 for collecting the classified median powder, a median powder suitable as a toner was obtained in a classification yield of 80% by weight, which had a volume average particle diameter of about 7.8 μm, containing 2.0% by volume of particles having a particle diameter of 4.0μ or less and containing 1.0% by volume of particles having a particle diameter of 12.7μ or more. The term "classification yield" herein used refers to a percentage of the amount of the median powder (product) finally obtained based on the total weight of the pulverized feed material fed. The resulting median powder was observed with an optical microscope to find that there was seen substantially no aggregate of about 5 μm or more resulting from the aggregation of ultrafine particles.

The classified coarse powder was collected in the collecting cyclone 306 and thereafter fed into the continuous feeder 302.

The median powder thus obtained was used as a toner, and 0.6% by weight of hydrophobic silica was mixed with the toner to prepare a developer. The developer thus prepared was supplied to a copying machine NP-1215 (available from Canon Inc.) to carry out copying tests. As a result, copied images were obtained, free of fog and with a good developing performance for thin lines.

EXAMPLE 2

| | |
|---|---|
| Styrene-acrylic resin | 100 parts |
| Magnetic material (0.3μ) | 60 parts |
| Charge controlling agent | 2 parts |
| Low-molecular polypropylene resin | 4 parts |

Materials used for preparing a toner, mixed in the above proportion, were kneaded under heating, and, after cooled, crushed and pulverized with a hammer mill to obtain a powder material, which was fed to the air current classifier as illustrated in FIG. 4, at a rate of 100 g/min., and the coarse powder separated was then flowed into a jet mill (a supersonic jet mill, manufactured by Nippon Pneumatic Kogyo K.K.) connected to the classifier in the manner as shown in FIG. 10, followed by fine grinding (grinding jet air pressure: 5 Kgf/cm$^2$). The finely ground powder material was again fed into the classifier together with a powder material obtained by coarse pulverization, and the separated fine powder was obtained as a finely ground product. The finely ground product was found to have an average particle diameter of 4.7 82 m, containing 0.1% by weight of the particles with a particle diameter of 10 μm or more, and obtained in an yield of 100 g/min. The average particle diameter corresponds to the median diameter of particle diameter/weight frequency distribution, and was measured using a Coulter counter manufactured by Coulter Electronics Co.

EXAMPLE 3

The same material as Example 2 was fed in the same classifier/jet mill system as Example 2 in the same feed rate (100 g/min) as Example 2, and a finely ground product was obtained under a grinding jet air pressure of 6 Kgf/cm$^2$. As a result, the product was found to have an average particle diameter of 3.7 μm, containing 0% by weight of the particles with a particle diameter of 10 μm or more, and obtained in an yield of 100 g/min.

Here, the quantity of the air flowed in the air current classifier together with the powder material was about 1.2 times that in Example 2.

COMPARATIVE EXAMPLE 1

The same material as Example 2 was fed in the air current classifier as illustrated in FIG. 5 in the same feed rate (100 g/min) as Example 2, and the separated coarse powder was flowed into a jet mill (a supersonic jet mill, manufactured by Nippon Pneumatic Kogyo K.K.) connected to the classifier, followed by fine grinding (grinding jet air pressure: 5 Kgf/cm$^2$). The finely ground material was again fed in the classifier together with a pulverized feed material, and the separated fine powder was obtained as a finely ground product. As a result, the product was found to have an average particle diameter of 7.5 μm, containing 15.0% by weight of the particles with a particle diameter of 10 μm or more, and obtained in an yield of 98 g/min.

COMPARATIVE EXAMPLE 2

The same material as Example 2 was fed in the same classifier/jet mill system as Comparative Example 1 in the same feed rate (100 g/min) as Example 2, and a finely ground product was obtained under a grinding jet air pressure of 6 Kgf/cm$^2$. As a result, the product was found to have an average particle diameter of 6.3 μm, containing 7.0% by weight of the particles with a particle diameter of 10 μm or more, and obtained in an yield of 97 g/min.

As will be seen from the above, finely ground products (separated fine powder) with a smaller particle diameter than that of Comparative Examples 1 and 2 were obtained in Examples 2 and 3.

In Example 3, the grinding jet air pressure was made larger by 1 Kgf/cm$^2$ than that in Example 2, with an increased air flow of 1.2 times, so that the particle diameter of the finely ground product was made smaller by about 20% as from 4.7 μm to 3.7 μm.

On the other hand, in Comparative Examples 2 and 1, the grinding jet air pressure was made larger by 1 Kgf/cm$^2$, but the particle diameter of the finely ground product was made smaller by only 15% as from 7.5 μm to 6.3 μm.

COMPARATIVE EXAMPLE 3

The same material as Example 2 was fed in the same classifier/jet mill system as Comparative Example 1, and a finely ground product with an average particle diameter of 4.7 μm was obtained under a grinding jet air pressure of 5 Kgf/cm$^2$, where the material was fed at a rate of 25 g/min at a maximum, and the product was obtained in an yield of 24 g/min. The finely ground product was found to have an average particle diameter of 4.7 μm, containing 0.5% by weight of the particles with a particle diameter of 10 μm or more.

As will be seen from the above, in Comparative Example 3, the throughput capacity decreased to ¼ to obtain the finely ground product having the same average particle diameter as Example 2.

EXAMPLE 4

Materials used for preparing a toner, mixed in the same proportion as Example 2, were kneaded under heating, and, after cooled, crushed and pulverized with a hammer mill, and the resulting powder material was fed to a jet mill (a supersonic jet mill, manufactured by Nippon Pneumatic Kogyo K.K.) to obtain a toner powder having an average particle diameter of 7.0 μm and containing 15% by weight of the particles with a particle diameter of 4.0 μm or less. The toner powder thus obtained was classified using the air current classifier as illustrated in FIG. 4 so as to give a separated fine powder with an average particle diameter of 4.0 μm as a diameter of separated particles. The separated fine powder had an average particle diameter of 4.0 μm and contained 7% by weight of the particles with a particle diameter of 2.5 μm or less. The separated coarse powder had an average particle diameter of 7.5 μm and contained 1.5% by weight of the particles with an average particle diameter of 4.0 μm or less. The separated fine powder and the separated coarse powder were yielded in the ratio of 20:80.

COMPARATIVE EXAMPLE 4

The same toner powder as Example 4, having an average particle diameter of 7.0 μm and containing 15% by weight of the particles with a particle diameter of 4.0 μm or less, was classified using the air current classifier as illustrated in FIG. 5 so as to give a separated fine powder with an average particle diameter of 4.0 μm as a diameter of separated particles. The separated fine powder had an average particle diameter of 4.0 μm and contained 15% by weight of the particles with a particle diameter of 2.5 μm or less. The separated coarse powder had an average particle diameter of 7.4 μm and contained 5% by weight of the particles with an average particle diameter of 4.0 μm or less. When compared with Example 4, Example 4 yielded powders with a sharper particle diameter/weight frequency distribution in both the fine powder and coarse powder.

Here, the separated fine powder and the separated coarse powder were yielded in the ratio of 25:75.

As described in the above, the present invention is constructed in the manner that the powder material and carrying air, flowed from the feed pipe 8 into the classifying chamber 4, are flowed into the classifying chamber 4 from the openings between the louvers 9 provided between the guide chamber 5 and classifying chamber 4, which are flowed from the entire circumference, with whirling and yet in a uniform powder material density. Hence, the powder material can be effectively classified with good accuracy. Moreover, the velocity toward the center, of the particles whirling in the classifying chamber 4 can be made small, and hence the diameter of separated particles can be made small. In particular, when the air flowed in together with the powder material is in a large quantity as in the system in which the classifier is connected to the jet mill, the effect of making small the diameter of separated particles can be remarkably exhibited, and products having a smaller particle diameter can be effectively obtained as the products finely ground with a jet mill.

We claim:

1. A separator for classifying powder with air current, comprising;

a powder feed pipe and a classifying chamber, provided in said separator;

a guide chamber provided at an upper part of said classifying chamber to communicate with said powder feed pipe;

a plurality of introducing louvers provided between said guide chamber and said classifying chamber, at which the powder is flowed in from said guide chamber to said classifying chamber through openings between said introducing louvers together with carrying air.

an inclined classifying plate raised at its central part, provided at the bottom of said classifying chamber;

classifying louvers provided along the side wall of said classifying chamber, through openings of which the air is flowed to produce a whirling stream by which said powder fed into said classifying chamber together with carrying air is centrifugally separated into fine powder and coarse powder;

a discharge opening provided at the central part of said classifying plate and from which the classified fine powder is discharged.

a fine powder discharge chute connected to said discharge opening; and a discharge opening formed along the periphery of said classifying plate and from which the classified coarse powder is discharged.

2. A separator according to claim 1, wherein said plurality of introducing louvers are arranged in the form of a ring.

3. A separator according to claim 1, wherein said classifying louvers are arranged in the form of a ring.

4. A separator according to claim 1, wherein said plurality of introducing louvers are arranged in the form of a ring, said classifying louvers are arranged in the form of a ring, and the inner diameter of the ring formed by the introducing louvers is smaller than the inner diameter of the ring formed by the classifying louvers.

5. A separator according to claim 1, wherein said introducing louvers are so provided that the powder may be flowed into the classifying chamber with whirling motion.

6. A separator according to claim 1, wherein said introducing louvers are so provided that the carrying air may produce a whirling stream in the classifying chamber.

7. A separator according to claim 6, wherein said classifying louvers are so provided that the whirling stream of the carrying air flowed in through the openings between the introducing louvers may be in the same direction with the whirling stream of the air flowed in through the openings between the classifying louvers.

8. A separator according to claim 1, wherein said classifying louvers are so provided that the air flowed in through the openings between the classifying louvers may produce a whirling stream inside the classifying chamber.

9. A separator according to claim 1, wherein said introducing louvers are so provided that the powder may be fed from the entire circumference of the guide chamber into the classifying chamber.

10. A separator according to claim 1, wherein said introducing louvers are provided along the entire circumference of an inner wall of the guide chamber, and said classifying louvers are provided along the entire circumference of the outer wall of the lower part of the classifying chamber.

11. A separator according to claim 1, wherein said powder feed pipe is provided at the upper part of the classifying chamber, and the powder fed through said powder feed pipe is flowed through the openings between the introducing louvers into the classifying chamber from the entire circumference of a guide chamber inner wall formed by the introducing louvers.

12. An apparatus for preparing a fine powder, equipped with a jet mill and a separator for classifying powder with air current, wherein;

said separator comprises a powder feed pipe and a classifying chamber, provided in said separator; a guide chamber provided at an upper part of said classifying chamber to communicate with said powder feed pipe; a plurality of introducing louvers provided between said guide chamber and said classifying chamber, at which the powder is flowed in from said guide chamber to said classifying chamber through openings between said introducing louvers together with carrying air; and inclined classifying plate raised at its central part, provided at the bottom of said classifying chamber; classifying louvers provided along the side wall of said classifying chamber, through openings of which the air is flowed to produce a whirling stream by which said powder fed into said classifying chamber together with carrying air is centrifugally separated into fine powder and coarse powder; an discharge opening provided at the central part of said classifying plate and from which the classified fine powder is discharged; a fine powder discharge chute connected to said discharge opening; and a discharge opening formed along the periphery of said classifying plate and from which the classified coarse powder is discharged;

a connecting pipe is provided for feeding the classified coarse powder to said jet mill; and a connecting pipe is provided for feeding powder ground in said jet mill, to said powder feed pipe.

13. An apparatus according to claim 12, wherein said plurality of introducing louvers are arranged in the form of a ring.

14. An apparatus according to claim 12, wherein said classifying louvers are arranged in the form of a ring.

15. An apparatus according to claim 12, wherein said plurality of introducing louvers are arranged in the form of a ring, said classifying louvers are arranged in the form of a ring, and the inner diameter of the ring formed by the introducing louvers is smaller than the inner diameter of the ring formed by the classifying louvers.

16. An apparatus according to claim 12, wherein said introducing louvers are so provided that the powder may be flowed into the classifying chamber with whirling motion.

17. An apparatus according to claim 12, wherein said introducing louvers are so provided that the carrying air may produce a whirling stream in the classifying chamber.

18. An apparatus according to claim 17, wherein said classifying louvers are so provided that the whirling stream of the carrying air flowed in through the openings between the introducing louvers may be in the same direction with the whirling stream of the air flowed in through the openings between the classifying louvers.

19. An apparatus according to claim 12, wherein said classifying louvers are so provided that the air flowed in through the openings between the classifying louvers may produce a whirling stream inside the classifying chamber.

20. An apparatus according to claim 12, wherein said introducing louvers are so provided that the powder may be fed from the entire circumference of the guide chamber into the classifying chamber.

21. An apparatus according to claim 12, wherein said introducing louvers are provided along an entire circumference of the inner wall of the guide chamber, and said classifying louvers are provided along the entire circumference of the outer wall of a lower part of the classifying chamber.

22. An apparatus according to claim 12, wherein said powder feed pipe is provided at the upper part of the classifying chamber, and the powder fed through said powder feed pipe is flowed through the openings between the introducing louvers into the classifying chamber from the entire circumference of a guide chamber inner wall formed by the introducing louvers.

23. A process for preparing a toner for developing electrostatic latent images, comprising;

melt-kneading a composition comprising at least a binder resin and a colorant, cooling and solidifying the kneaded product, and pulverizing the solidified product to prepare a pulverized feed material;

feeding the pulverized feed material to a first classifying step to classify the feed material into coarse powder and fine powder; wherein said first classifying step is carried out using a separator for classifying the pulverized feed material with air current;

said separator comprising; a powder feed pipe and a classifying chamber; a guide chamber provided at the upper part of said classifying chamber to communicate with said powder feed pipe; a plurality of introducing louvers provided between said guide chamber and said classifying chamber, at which the powder is flowed in from said guide chamber to said classifying chamber through the openings between said introducing louvers together with carrying air; an inclined classifying plate raised at its central part, provided at the bottom of said classifying chamber; classifying louvers provided along the side wall of said classifying chamber, through the openings of which the air is flowed to produce a whirling stream by which said powder fed into said classifying chamber together with carrying air is centrifugally separated into fine powder and coarse powder; a discharge opening provided at the central part of said classifying plate and from which the classified fine powder is discharged; a fine powder discharge chute connected to said discharge opening; and a discharge opening formed along the periphery of said classifying plate and from which the classified coarse powder is discharged;

feeding the classified coarse powder to a grinding step and thereafter feeding back the ground product to the first classifying step;

introducing the classified fine powder into a multi-divided classification zone separated into at least three divisions by a dividing means, to which the particles of the fine powder are allowed to fall along curved lines by the Coanda effect, where a coarse powder portion mainly comprised of particles having a particle size above a prescribed range is collected in a first division, a median powder portion mainly comprised of particles having a particle size within the prescribed range is collected in a second division, and a fine powder portion mainly comprised of particles having a particle size below the prescribed range is collected in a third division; and feeding back said coarse powder portion collected, to the first classifying step together with the pulverized feed material.

24. An apparatus for preparing a toner for developing electrostatic latent image, comprising;

a continuous feed means for continuously feeding a pulverized feed material powder for the toner;

a first classifying means for classifying into fine powder and coarse powder the pulverized feed material fed from said continuous feed means;

said first classifying means comprises a separator for classifying the pulverized feed material with air current; said separator comprising; a powder feed pipe and a classifying chamber; a guide chamber provided at an upper part of said classifying chamber to communicate with said powder feed pipe; a plurality of introducing louvers provided between said guide chamber and said classifying chamber, at which the powder is flowed in from said guide chamber to said classifying chamber through openings between said introducing louvers together with carrying air; an inclined classifying plate raised at its central part, provided at the bottom of said classifying chamber; classifying louvers provided along the side wall of said classifying chamber, through openings of which the air is flowed to produce a whirling stream by which said powder fed into said classifying chamber together with carrying air is centrifugally separated into fine powder and coarse powder; a discharge opening provided at the central part of said classifying plate and from which the classified fine powder is discharged; a fine powder discharge chute connected to said discharge opening; and a discharge opening formed along the periphery of said classifying plate and from which the classified coarse powder is discharged;

a grinding means for grinding the coarse powder classified in the first classifying means;

a feeding means for feeding the powder ground by the grinding means;

a multi-divided classifying means having a Coanda block, by which the fine powder classified by said first classifying means is classified into at least a coarse powder portion, a median powder portion and a fine powder portion by the Coanda effect; and a feed-back means for feeding back the coarse powder classified by said multi-divided classifying means, to said continuous feed means.

* * * * *

UNITED STATES PATENT AND TRADEMARK OFFICE

CERTIFICATE OF CORRECTION

PATENT NO. : 5,016,823

DATED : May 21, 1991

INVENTOR(S) : MASAYOSHI KATO, ET AL.

It is certified that error appears in the above-identified patent and that said Letters Patent is hereby corrected as shown below:

On the title page:

Insert: -- [30] Foreign Application Priority Data
Feb. 12, 1988 [JP] Japan ..... 63-30321 --.

IN [56] REFERENCES CITED

Under U.S. PATENT DOCUMENTS, insert:

-- 4,153,541 5/1979 Rumpf et al.
4,221,655 9/1980 Nakayama et al. --.

Under FOREIGN PATENT DOCUMENTS, insert:

-- 0048378 4/1979 Japan
0079870 6/1979 Japan
0081172 6/1979 Japan
2580831 4/1985 France
2538190 3/1979 Fed. Rep. of Germany
2949618 6/1981 Fed. Rep. of Germany
3346445 7/1985 Fed. Rep. of Germany
3403940 6/1985 Fed. Rep. of Germany --.

After FOREIGN PATENT DOCUMENTS, insert:

-- OTHER PUBLICATIONS

Ueda, et al., "Dry Classifier With Collecting Chamber", Nagoya Industrial Science And Technology Lab. Reports, 8 [4], 235, 1959.

"Iitani's Classifier", Journal J.S.M.E., 59, [3], 215, 1956. --.

UNITED STATES PATENT AND TRADEMARK OFFICE

CERTIFICATE OF CORRECTION

PATENT NO. : 5,016,823

DATED : May 21, 1991

INVENTOR(S) : MASAYOSHI KATO, ET AL.

It is certified that error appears in the above-identified patent and that said Letters Patent is hereby corrected as shown below:

IN [57] ABSTRACT

Line 18, "provide" should read --provided--.

SHEET 6 OF 8

FIG. 10, "FINLY" should read --FINELY--.

COLUMN 1

Line 23, "Society" should be deleted.

COLUMN 3

Line 22, "A still" should read --Still--.
Line 28, "comprising;" should read --comprising:--.

COLUMN 4

Line 8, "provide" should read --provided--.
Line 19, "a" should be deleted.
Line 22, "prising;" should read --prising:--.
Line 32, "prising;" should read --prising:--.
Line 47, "is" should read --and which is--.
Line 49, "provide" should read --provided--.

COLUMN 5

Line 9, "comprising;" should read --comprising:--.
Line 17, "comprising;" should read --comprising:--.
Line 31, "is" should read --and which is--.

UNITED STATES PATENT AND TRADEMARK OFFICE

CERTIFICATE OF CORRECTION

PATENT NO. : 5,016,823

DATED : May 21, 1991

INVENTOR(S) : MASAYOSHI KATO, ET AL.

It is certified that error appears in the above-identified patent and that said Letters Patent is hereby corrected as shown below:

COLUMN 5

Line 33, "provide" should read --provided--.
Line 65, "line III-13 III" should read --line III-III--.

COLUMN 6

Line 30, "ver 7")" should read --vers 7")--.
Line 62, "louver 7" should read --louvers 77--.

COLUMN 7

Line 41, "b y" should read --by--.

COLUMN 8

Line 50, "range," should read --range),--.

COLUMN 9

Line 8, "am" should read --an--.
Line 26, "resectively" should read --respectively--
and "as" should read --gas--.
Line 31, "of" should read --on--.

COLUMN 10

Line 13, "broard" should read --broad--.
Line 42, "form" should read --from--.

UNITED STATES PATENT AND TRADEMARK OFFICE

CERTIFICATE OF CORRECTION

PATENT NO. : 5,016,823

DATED : May 21, 1991

INVENTOR(S) : MASAYOSHI KATO, ET AL.

It is certified that error appears in the above-identified patent and that said Letters Patent is hereby corrected as shown below:

COLUMN 11

Line 1, "classifier 308" should read --grinding machine 308--.
Line 40, "Nipon" should read --Nippon--.

COLUMN 12

Line 65, "was" should read --were--.

COLUMN 13

Line 15, "machine 308," should read --machine 308--.
Line 17, "ground," should read --grinding,--.

COLUMN 14

Line 28, "4.7 82 m," should read --4.7 μm,--.
Line 30, "an" should read --a--.
Line 44, "an" should read --a--.
Line 64, "an" should read --a--.

COLUMN 15

Line 6, "an" should read --a--.
Line 30, "an" should read --a--.

COLUMN 16

Line 8, "Example 4," (first occurrence) should read --Comparative Example 4,--.
Line 23, "center," should read --center--.

UNITED STATES PATENT AND TRADEMARK OFFICE

CERTIFICATE OF CORRECTION

PATENT NO. : 5,016,823

DATED : May 21, 1991

INVENTOR(S) : MASAYOSHI KATO, ET AL.

It is certified that error appears in the above-identified patent and that said Letters Patent is hereby corrected as shown below:

COLUMN 16

Line 46, "air." should read --air;--.
Line 58, "discharged." should read --discharged;--.

COLUMN 17

Line 65, "an" should read --a--.

COLUMN 19

Line 1, "comprising;" should read --comprising:--.

COLUMN 20

Line 10, "comprising;" should read --comprising:--.

Signed and Sealed this

Sixteenth Day of February, 1993

*Attest:*

STEPHEN G. KUNIN

*Attesting Officer*

*Acting Commissioner of Patents and Trademarks*